US007971758B2

(12) United States Patent
Campbell et al.

(10) Patent No.: US 7,971,758 B2
(45) Date of Patent: Jul. 5, 2011

(54) CAULK GUN

(75) Inventors: David C. Campbell, Bel Air, MD (US); Louis A. Gibbons, Stevensville, MD (US)

(73) Assignee: Black & Decker Inc., Newark, DE (US)

( * ) Notice: Subject to any disclaimer, the term of this patent is extended or adjusted under 35 U.S.C. 154(b) by 1192 days.

(21) Appl. No.: 11/271,135

(22) Filed: Nov. 10, 2005

(65) Prior Publication Data

US 2007/0102457 A1 May 10, 2007

(51) Int. Cl.
*B67D 7/60* (2010.01)

(52) U.S. Cl. ..... 222/391; 222/326; 222/327; 222/333

(58) Field of Classification Search ..... 222/333, 222/391, 326, 327, 390, 325, 386; 74/116, 74/118, 567, 569; 184/105.1, 105.2
See application file for complete search history.

(56) References Cited

U.S. PATENT DOCUMENTS

| | | | | |
|---|---|---|---|---|
| 4,171,072 | A | 10/1979 | Davis, Jr. | |
| 4,249,677 | A | 2/1981 | Davis, Jr. | |
| 4,264,021 | A | 4/1981 | Davis, Jr. | |
| 4,273,269 | A * | 6/1981 | Davis, Jr. | 222/326 |
| 4,566,610 | A | 1/1986 | Herb | |
| 4,986,454 | A * | 1/1991 | Riley | 222/327 |
| 5,370,282 | A | 12/1994 | Sedlmeoer | |
| 5,375,309 | A * | 12/1994 | Dunn | 29/237 |
| 5,511,699 | A | 4/1996 | Tepic | |
| 5,672,155 | A | 9/1997 | Riley et al. | |
| 5,762,239 | A * | 6/1998 | Cossette | 222/333 |
| 5,775,539 | A | 7/1998 | Bates et al. | |
| 5,909,830 | A | 6/1999 | Bates et al. | |
| 6,234,348 | B1 | 5/2001 | Okamura et al. | |
| 6,241,130 | B1 | 6/2001 | Heiberger | |
| 6,286,718 | B1 | 9/2001 | Durrant | |
| 6,745,921 | B2 * | 6/2004 | Beckett | 222/391 |

FOREIGN PATENT DOCUMENTS

| | | |
|---|---|---|
| CA | 2 400 717 A1 | 9/2001 |
| DE | 35 35 229 A1 | 4/1987 |
| DE | 36 02 975 A1 | 8/1987 |

* cited by examiner

*Primary Examiner* — Frederick C. Nicolas
(74) *Attorney, Agent, or Firm* — Bruce S. Shapiro; John Yun; Stephen R. Valancius

(57) ABSTRACT

A motorized caulk gun has a housing which receives a plunger. The plunger is disposed adjacent to caulk cartridge which is received in the housing. The plunger is movable in a first direction to discharge caulk from the cartridge. A first and second plate moves the plunger rod in a direction to squeeze caulk from the cartridge. A first and second cam act on the plates via a cam follower such that the plates alternately engage the plunger rod to drive it in a forward direction to squeeze caulk from the cartridge.

22 Claims, 7 Drawing Sheets

CAULK GUN

FIELD OF THE INVENTION

The present invention relates to caulk guns and, more particularly, to a power operated caulk gun which also is operable in manual mode.

BACKGROUND OF THE INVENTION

Motorized caulk guns which include a piston rod acting on the internal piston of a caulk cartridge are known. An example of such a gun is shown in U.S. Pat. No. 4,264,021, in which a piston rod extends through and is driven by a drive plate. The drive plate is further driven by a cam mounted on a gear, with the gear driven by the motor. Though this system provides for power operation, it suffers from the drawback that the rate of advance of the piston is inconsistent since the drive plate is necessarily out of contact with the cam surface at some time during each rotation of the gear on which the cam is mounted. In addition, the trigger mechanism functions only to control the motor, and does not otherwise control movement of the piston rod. As a result, no manual operation of the caulk gun is possible.

BRIEF SUMMARY OF THE INVENTION

The present invention in one embodiment is directed to a fluid discharger having a housing. A plunger including a rod is disposed adjacent to a mass of fluid receivable in the housing. The plunger is movable in a first direction to act upon and discharge the fluid from the housing. A first plate and a second plate each have an opening, and the plunger rod is disposed through the openings. The first and second plates have a first position relative to the plunger rod. The first plate has an associated first cam follower and the second plate has an associated second cam follower. The discharger includes a first translationally movable and rotatable cam and a second translationally movable and rotatable cam. Translational movement of the first and second cams causes translational movement of the first and second plates, respectively, to move the first and second plates into a second position relative to said plunger rod. When the first and second plates are in the second position, rotation of the first cam and the second cam causes the first and second plates to push the plunger in the first direction to discharge fluid, with the pushing provided to the plunger by the first plate alternating with the pushing provided on said plunger by the second plate.

The present invention provides the art with a powered caulk gun which regulates flow to provide an even bead. In addition, the caulk gun is controlled to prevent oozing after the trigger is released. In one embodiment, the oozing is prevented upon trigger release, even if the motor remains on. The invention also provides a manual as well as powered operation mode.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figures 1, 2:
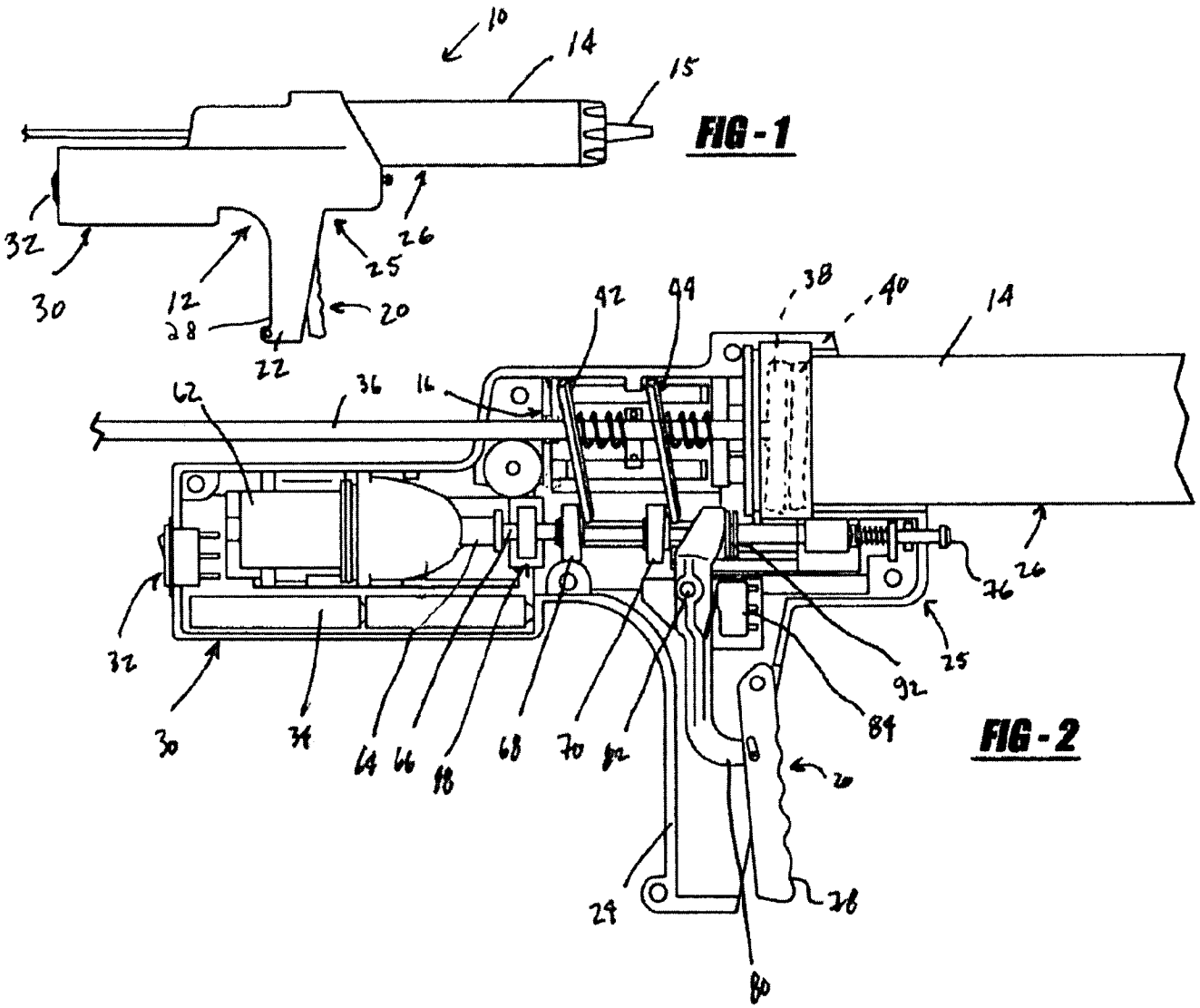
FIG. 1 is a perspective view of a caulk gun in accordance with the present invention.
FIG. 2 is a cross-section view of the internal components of the gun shown in FIG. 1.

The following description of the preferred embodiment(s) is merely exemplary in nature and is in no way intended to limit the invention, its application, or uses.

Turning to the figures, a motorized caulk gun is illustrated and designated with the reference numeral 10. Caulk gun 10 includes housing 12 which receives conventional caulk cartridge or tube 14 having nozzle 15. Tube 14 includes internal piston 40 disposed behind a mass of caulk such that when piston 40 moves within tube 14, caulk is expelled from nozzle 15. Housing 12 contains plunger mechanism 16 which drives internal piston 40, and motor drive 18 including motor 62 which activates plunger mechanism 16. Motor drive 18 and plunger mechanism 16 are actuated by trigger mechanism 20.

Housing 12 is of a clam shell design including halves 22 and 24. Housing 12 includes front section 26 which receives caulk tube 14 and midsection 25 which includes handle portion 28. Midsection 25 contains plunger mechanism 16. Housing 12 includes rear section 30 which houses motor drive 18. Conventional on/off switch 32 is mounted on rear portion 30 and serves as a master control switch for the gun such that when switch 32 is in the on position, the motor may be switched on by actuation of trigger 78 as explained further below, and when switch 32 is in the off position, the motor cannot be operated. Batteries 34 are housed adjacent the motor drive 18 to provide power to motor 62.

Plunger mechanism 16 includes plunger rod 36 having piston 38 mounted at one end so as to be disposed adjacent internal piston 40 of caulking tube 14. Plunger rod 36 extends through openings 50 in a pair of pinch plates 42 and 44. Springs 52 and 54 are disposed about plunger rod 36 and between an internal element of the housing and the pinch plates and bias the pinch plates in one axial direction. For example, the springs bias plate 42 and 44 towards the rear of the housing, or towards the left as shown in FIG. 2. Each pinch plate includes a cam follower such as roller 56 disposed through its lower end. When disposed substantially vertically, pinch plates 42, 44 allow plunger rod 36 to move substantially freely through openings 50. In one embodiment, when pinch plates 42,44 are angled less than about 5° to a vertical plane, such free movement is allowed. However, when pinch plates 42, 44 are tilted relative to the axis of rod 36 greater than a certain angle, the pinch plates grip the surface of plunger rod 36 at openings 50. In one embodiment, when pinch plates are angled between about 7°-10°, such gripping occurs.

Figure 6A:
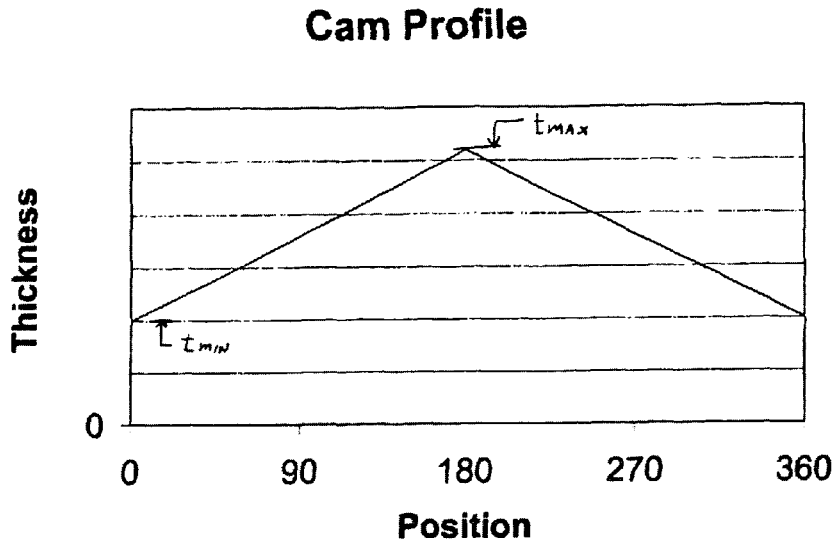
FIG. 6*a* is a graph showing the varying thickness of a cam shown in FIG. 6*b*.
Figure 6B:
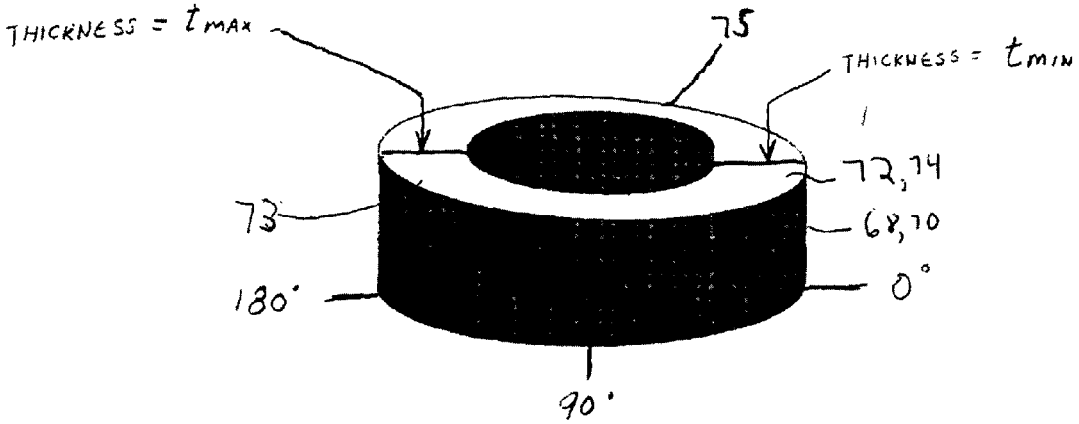
FIG. 6*b* is a perspective showing the varying thickness of the cams.

Motor drive 18 includes motor 62 with output shaft 64 coupled with shaft 66 of the trigger mechanism in a splined fit so as to allow axial (or lateral) movement of shaft 66. In a preferred embodiment, shaft 66 is movable axially 4-8 mm. Shaft 66 is supported by bearings in the housing and has cams 68 and 70 fixedly disposed thereon such that the cams rotate and move translationally with the shaft. In particular, cams 68,70 move axially when shaft 66 is moved axially. Cams 68 and 70 increase in thickness in the circumferential direction to provide ramped cam surfaces 72 and 74. With reference to FIGS. 6*a* and 6*b*, cams 68, 70 are essentially disc-shaped but have a varying thickness to create the ramped surfaces on one side. Moving circumferentially along one side of the ramped surface, the thickness increases substantially linearly from the 0° reference point at which the thickness is $t_{min}$, to the 180° point, at which the thickness is $t_{max}$, so as to provide up ramp 73. Continuing along the ramped surface from the 180° point to the 0° point, the thickness decreases substantially linearly back to $t_{min}$ to create down ramp 75. (The terms "up" and "down" are used for convenience of description and will depend on the direction of rotation of the cams.) Cams 68 and 70 are disposed on shaft 66 so as to be 180° out of phase with each other, that is, when the $t_{max}$ of cam 68 is directly above shaft 66, $t_{min}$ of cam 70 is directly below shaft 66, and the up ramp of cam 68 is on the opposite side of the shaft axis from the up ramp of cam 70, as shown in exaggeration in FIGS. 3*a*,3*b*. The overall thickness of the cams is a design choice, while in a preferred embodiment of the invention the difference between $t_{max}$ and $t_{min}$ is in a range of between about 0.8 mm and 1.6 mm.

Trigger 78 is mechanically linked to shaft 66 via lever 80 in a conventional manner such that when the trigger is pressed, shaft 66 is moved laterally forwardly in the housing. Lever 80 pivots about pivot pin 82. Adjustment mechanism 76 which may be a screw is disposed in the housing adjacent the distal end of shaft 66. The screw acts as a stopper for lateral movement of shaft 66 such that by adjustment of the screw position, the maximum distance of axial travel allowed for shaft 66 may be set. Lever 80 also actuates switch 84 which, when master on/off switch 32 is in the on position, activates the motor and causes rotation of shaft 66.

Figure 3:
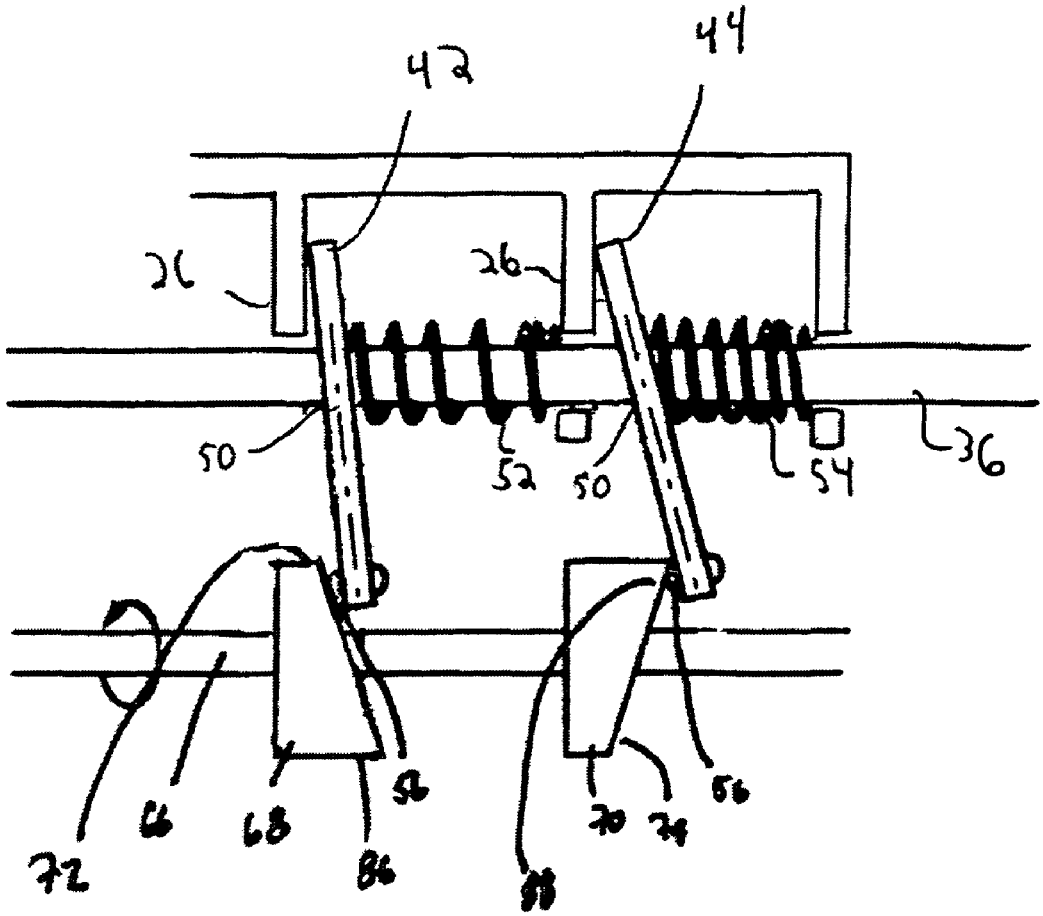
FIG. 3 is an enlarged exaggerated view of the drive mechanism of FIG. 2 in a first position.

The caulk gun functions as follows: In the initial position, before trigger 78 is squeezed, both cams 68 and 70 are in their rearward-most position, as shown in FIG. 3. In this position, springs 52,54 bias plates 42,44 to the left such that the top edges of plates 42,44 are in contact with interior ribs 26 of the housing and cams 68 and 70 are in contact with their respective cam followers 56. The angle made by plates 42,44 will depend upon which portion of the cam their respective follower 56 is in contact, however, ribs 26 are positioned to ensure that plates 42,44 are substantially vertically disposed in this first position so as to allow free movement of plunger rod 36 through openings 50. If desired, the gun may be designed with both cams 68 and 70 out of contact with followers 56 of plates 42, 44 in this position, so long as other supporting internal structure is provided to hold the plates in the substantially vertical orientation.

Figure 3A:
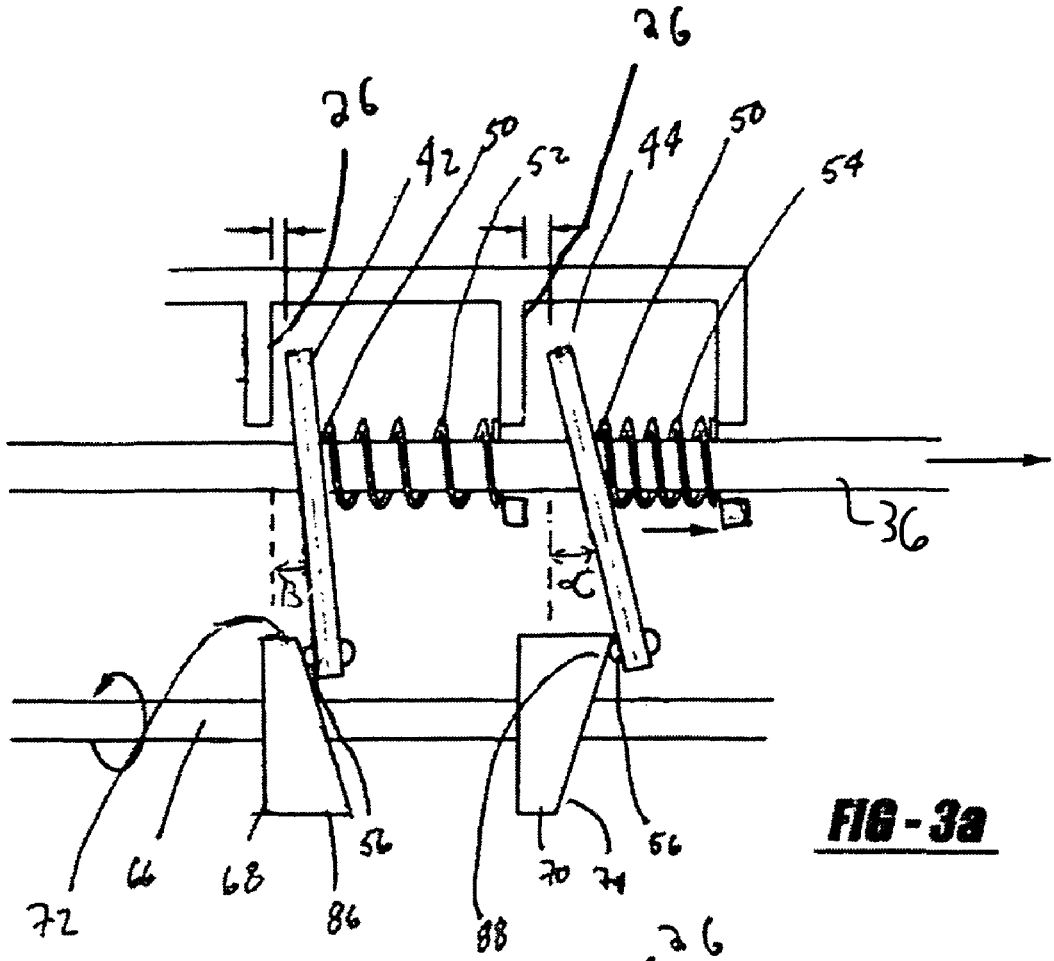
FIG. 3*a* is an enlarged exaggerated view of the drive mechanism of FIG. 2 in a second position.

As shown in FIGS. 2 and 3*a*, when trigger 78 is squeezed, each cam 68,70 is moved axially along with shaft 66. The axial movement of cams 68,70 pushes plates 42,44 out of contact with ribs 26 such that there is sufficient spacing between ribs 26 and the upper ends of the plates to thereby allow plates 42,44 to tilt past the substantially vertical position described above. The tilting is a result of the combined action of springs 52,54 biasing the plates to the left near the center of the plates, and the axial contact of the cams which pushes the plates to the right near the bottom of the plates. The tilting causes the plates to come into gripping contact with plunge rod 36 at openings 50.

Substantially simultaneously, switch 84 will be switched on, and shaft 66 and thus cams 68 and 70 rotate. Since as noted, cams 68 and 70 are 180° out of phase, roller 56 of one pinch plate will ride along up ramp 73 of its cam to thus increase its tilt, while roller 56 of the other pinch plate will ride along down ramp 75 (which may also include a flat portion) to thus decrease its tilt under the spring bias. At any time during the rotation, the pinch plate 42 or 44 which is undergoing increasing tilting acts to push plunger rod 36 laterally to the right, such that piston 38 acts upon caulk tube piston 40 to squeeze the caulk from nozzle 15. The other pinch plate is moving in the opposite direction relative to the plunger rod axis and is either releasing its pinch or may be out of contact altogether with the rod. In either case, the other pinch plate has no effect upon the rod during the time when it is moving along the down ramp.

Figure 3B:
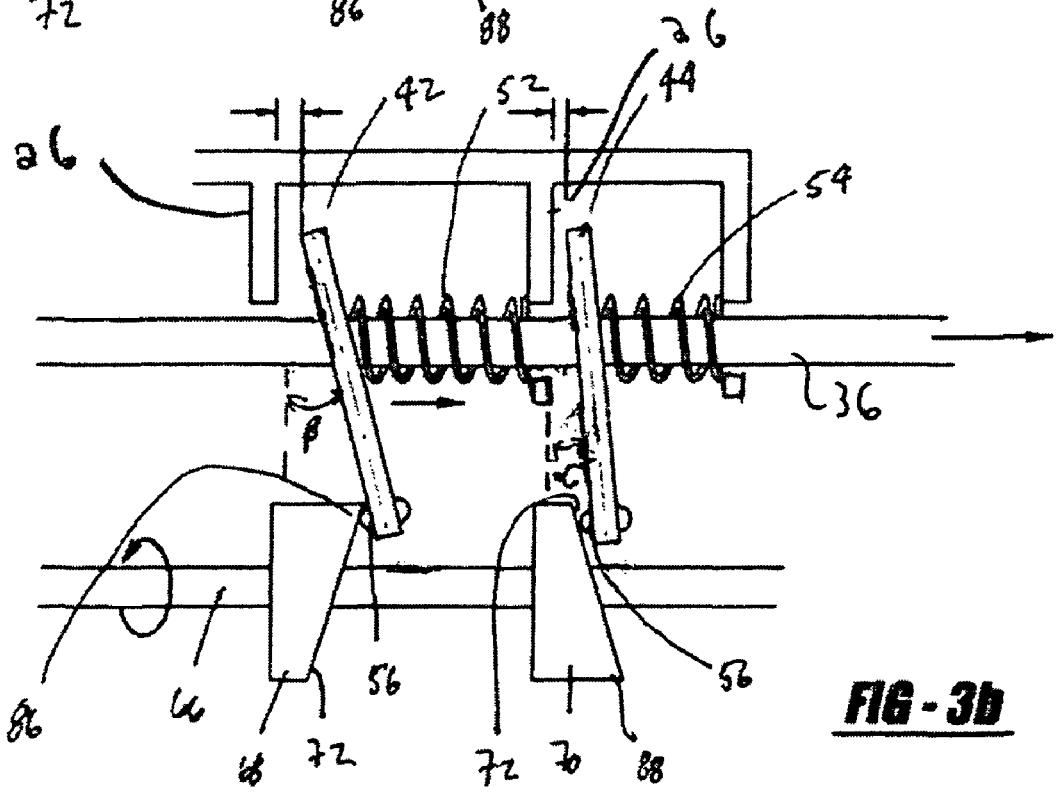
FIG. 3*b* is an enlarged exaggerated view of the drive mechanism as shown in FIG. 3*a* with the cams rotated through 180°.

For example, during the one half rotation of shaft 66 from the position shown in FIG. 3*a* to that of FIG. 3*b*, roller 56 of pinch plate 42 will move from a position where it is adjacent the $t_{min}$ of cam 68 to a position adjacent the $t_{max}$ point of cam 68. During this time, the tilt angle "β" of plate 42 relative to the vertical increases. Conversely, roller 56 of pinch plate 44 will move from a position where it is adjacent $t_{max}$ of cam 70 to a position adjacent the $t_{min}$ of cam 70. During this time, the tilt angle "α" decreases. Therefore, during the one half rotation of shaft 66 leading to the plates assuming the position shown in FIG. 3*b*, pinch plate 42 provided the pushing action upon plunge rod 36, while pinch plate 44 provided no pushing action. In the next one half rotation of shaft 66, the cams and pinch plates will move back to the position shown in FIG. 3*a* in which roller 56 of pinch plate 44 is adjacent $t_{max}$ of cam 70 and roller 56 of pinch plate 42 is adjacent $t_{min}$ of cam 68. During this time period, pinch plate 44 increases in tilt and provides the pushing action on plunger rod 36 while pinch plate 42 provides no pushing action.

Since the cams are 180° out of phase, plunger rod 36 is always being pushed by one pinch plate. When the cam follower of that active plate reaches the maximum camming surface of its cam, the cam follower of the inactive plate reaches the minimum camming surface of its cam. As soon as the active plate cam follower moves past the maximum point and begins to ride along the down ramp and that plate becomes inactive, the follower of the previously inactive cam plate begins to ride along the up ramp of its cam to thereby make its associated plate the active plate. In this manner, plates 42 and 44 alternately serve to provide for axial movement of plunger rod 36, and do so in a smooth and continuous manner, with no gap periods during which the rod is not moved. Thus, a continuous stream of caulk is squeezed from nozzle 15.

Although in the disclosed embodiment each cam has a single up ramp and a single down ramp, each cam could have multiple up ramps and down ramps, so long as the up ramps of one cam are disposed on the shaft out of phase with the up ramps of the other cam. For example, if each cam included two up ramps and two down ramps, then during each rotation of the shaft each cam would provide two periods of pushing action on the plunger rod and would have two periods of providing no pushing action. Similarly, although in the disclosed embodiment only two pinch plates and cams are shown, any number could be used, with a corresponding adjustment between the ratio of the arc defined by the up ramp to the arc defined by the down ramp for each cam. For example, if three cams and pinch plates were used, each cam would have an up ramp defining 120° of its surface, and the remaining 240° would define a down ramp. The cams would be disposed on the shaft such that the up ramps were spaced about the shaft axis in a non-overlapping manner. Once again, at any given time during rotation, the cam follower of only one of the plates would be riding on an up ramp and thus would be experiencing positive camming, and only that pinch plate would exert a translational force on plunger rod 36.

When pressure is released from trigger 78, the motor is de-energized stopping rotation of shaft 66. As this happens, shaft 66 and cams 68 and 70 are moved rearwardly, and pinch plates 42, 44 are moved under the spring bias to a neutral position substantially perpendicular to plunger rod 36, allowing rod 36 to move freely through center openings 50. The pressure created in the caulk tube due to the compression of the caulk, along with the reversing action of the pinch plates on plunger rod 36 as the plates are biased back to the substantially vertical position as the upper ends contact ribs 26 (FIG. 3), drives plunger rod 36 to the rear, allowing the caulk flow to stop promptly and prevent oozing. Although as described above, the motor is substantially simultaneously de-energized when trigger 78 is released to move cams 68 and 70 rearwardly, the caulk gun may be constructed to allow trigger 78 to assume an intermediate release position in which cams 68 and 70 are moved rearwardly far enough to allow plates 42 and 44 to assume the substantially vertical position while switch 84 remains on. In this position, dispensing of the caulk will cease, and oozing will be prevented as well since plunger rod 36 will be moved rearwardly. However, the motor will continue to run until trigger 78 is released far enough to allow switch 84 to turn off.

In the embodiments described above, with switch 32 in the off position, when trigger 78 is squeezed shaft 66 is moved forwardly through the mechanical link provided by lever 80. Plunger rod 36 also is moved forwardly, even without the camming action provided by rotation of cams 68,70 due simply to the contact of the cams on the followers of pinch plates 42, 44 in the axial direction. However, when trigger 78 is released, pinch plates 42, 44 are restored to their initial position by the bias springs and the fact that the upper ends of the plates contact ribs 26, which causes plunger rod 36 to move back towards its initial position since when the cams are not rotated, neither cam provides a forwardly acting force on plunger rod 36. As result, forward movement of plunger rod 36 is mostly nullified, and trigger 78 could not be used effectively to manually squeeze the caulk from caulk tube 14.

Figure 4:
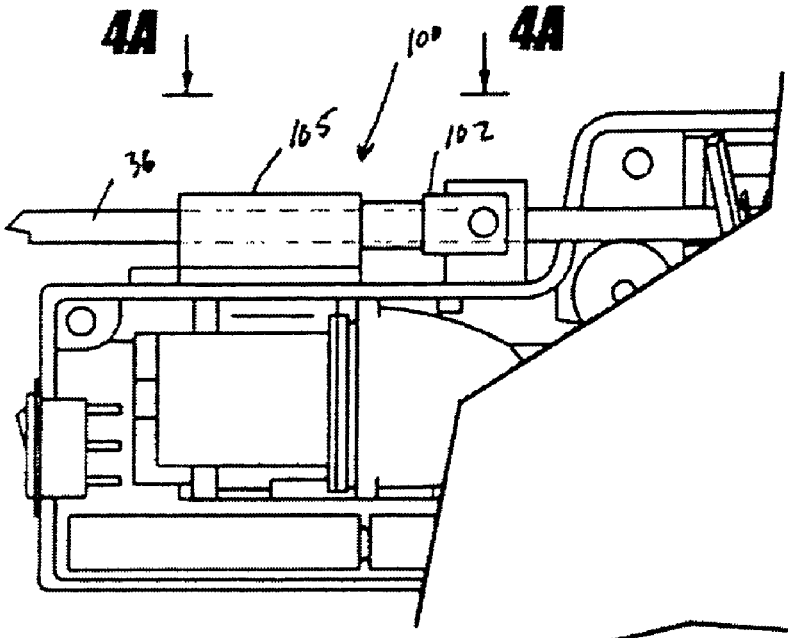
FIG. 4 is a side elevation view of a switching device for manual operation.
Figure 4A:
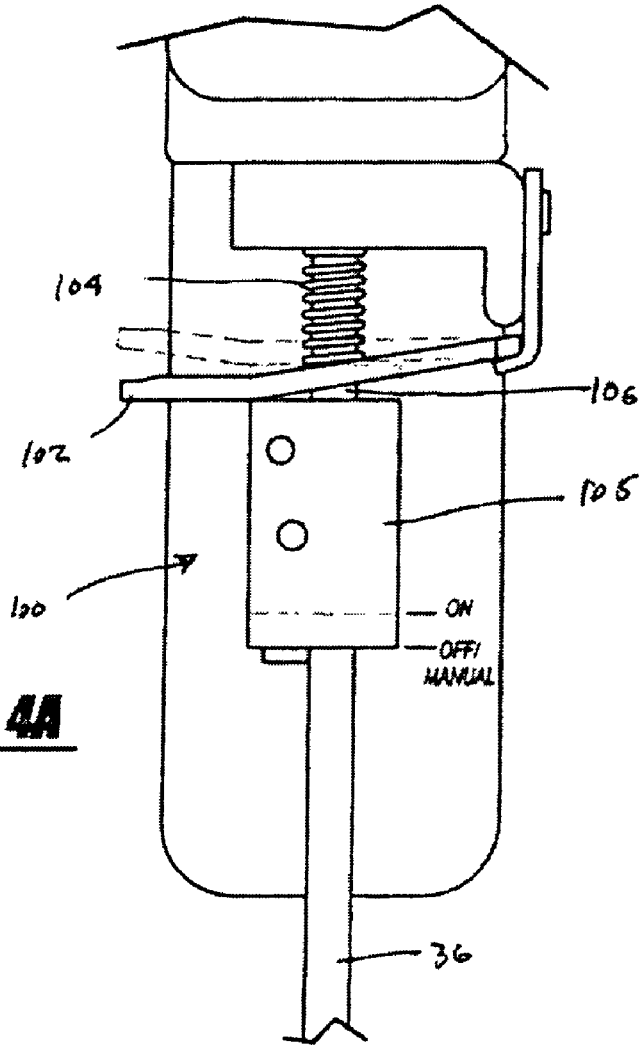
FIG. 4*a* is a top plan view of the switching device.

In order to provide for manual dispensing of the caulk by action of trigger 78, plunger rod 36 must be maintained in position each time the trigger is released. Structure 100 for providing this function is shown in FIGS. 4 and 4*a*. Structure 100 includes third pinch plate 102 which acts as a locking plate, and spring 104 acting on plate 102. Pinch plate 102 includes an aperture 106 which receives plunger rod 36. Pinch plate 102 is fixed at one end to housing 12. Spring 104 biases pinch plate 102 towards a rearward position in which it holds plunger rod 36 against rearward movement when trigger 78 is released and plates 42,44 return to the non-gripping position. Therefore, each time trigger 78 is squeezed during manual operation, plunger rod 36 is incrementally pushed forward by the axial movement of the cams, such that piston 38 acts on tube piston 40 to squeeze the caulk from caulk tube 14.

The position of pinch plate 102 is controlled by slider switch 105 disposed in the housing. When slider switch 105 is in the rearward position, pinch plate 102 is moved to the inclined position securing plunger rod 36 against rearward movement and allowing manual mode of operation. When slider switch 105 is moved forwardly, pinch plate 102 is pushed forwardly to compress spring 104. Plate 102 assumes a neutral or perpendicular position which enables plunger rod 36 to move freely through aperture 106 and the caulk gun is set for motorized operation.

In a preferred embodiment, slider switch 105 simultaneously controls operation of the caulk gun master on/off switch 32 as well, such that when slider switch 105 is in the rearward or off position, switch 32 is in the off position precluding motor 62 from operating at any time that pinch plate 102 is in contact with plunger rod 36. That is, the motor cannot be inadvertently activated at any time when the caulk gun is in manual mode. Such inadvertent activation would preclude operation of the anti-oozing feature described above since if switch plate 102 is engaged with plunger rod 36 during motorized driving of rod 36, rod 36 would not be able to move backwardly under the urging of the springs acting on plates 42, 44 once the trigger is released. By ensuring that motorized operation is possible only when rod 36 is free to move backwardly upon release of the trigger, the anti-oozing feature is always engaged when the gun is used in motorized mode.

As described above, adjustment screw 76 acts as an abutment to the end of shaft 66 to thereby provide a maximum for the lateral movement of shaft 66. During rotation of cams 68,70, as each follower rides along a cam to push the plunger rod 36 against the caulk tube piston, there is a reaction force which may cause the user to feel a pulsing action. As a result, it may be difficult to maintain trigger 78 at a steady position to provide constant flow rate. The provision of screw 76 as a stop helps the user hold trigger 78 at a steady position to provide constant flow.

Although in the above embodiments caulk gun 10 has been described as including master on/off switch 32, such a switch could be eliminated altogether, in which case the operation of motor 62 would be controlled only by trigger 78 through switch 84. Whenever trigger 78 was pulled past a predetermined position, motor 62 would actuate. Further pulling of trigger 78 would cause plates 42 and 44 to move to their shaft gripping position and caulk would be dispensed. As a further alternative, switch 84 could be eliminated and only master on/off switch 32 would be provided. In this case, switch 32 would be switched on to activate motor 62, which would continually rotate shaft 66 and cams 68 and 70. Trigger 78 would be squeezed to dispense caulk and released to cause dispensing to cease, with the anti-oozing action as described above. Trigger 78 would not control operation of motor 62.

Figure 5A:
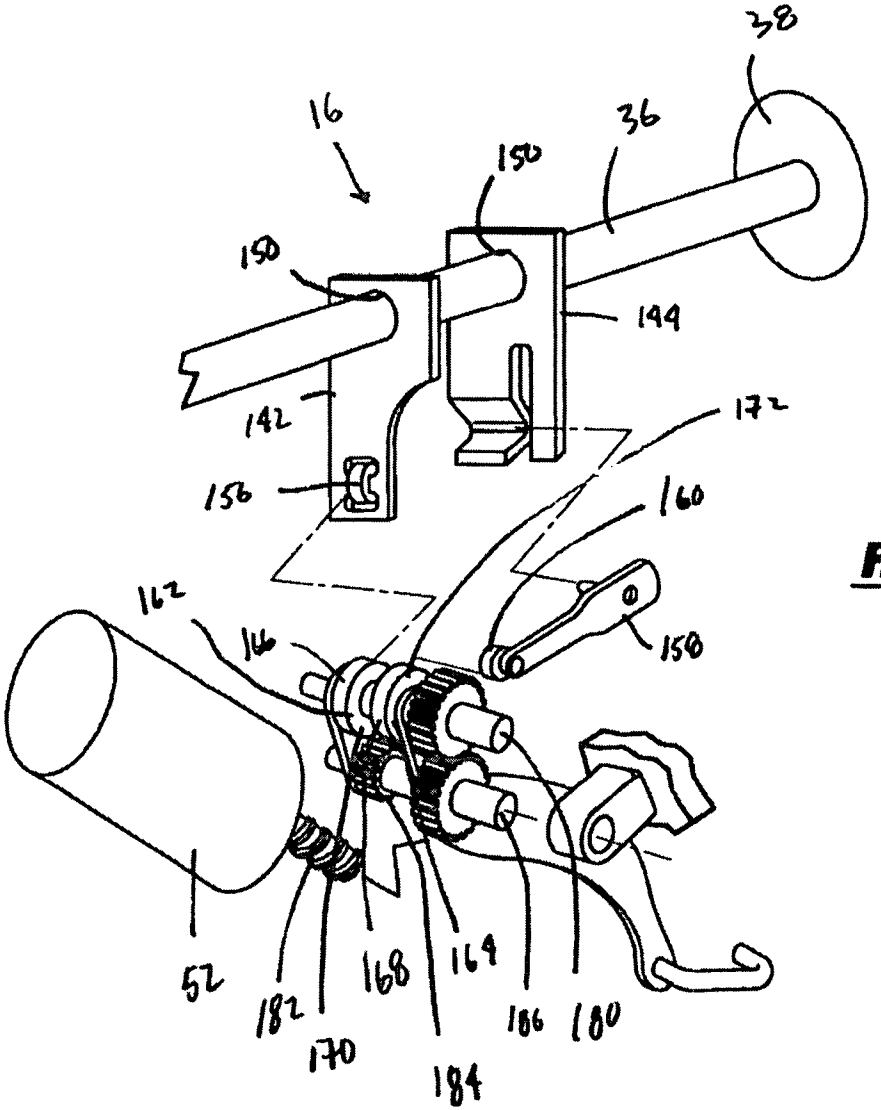
FIG. 5*a* is a partially exploded perspective view of a second embodiment of the present invention.
Figure 5B:
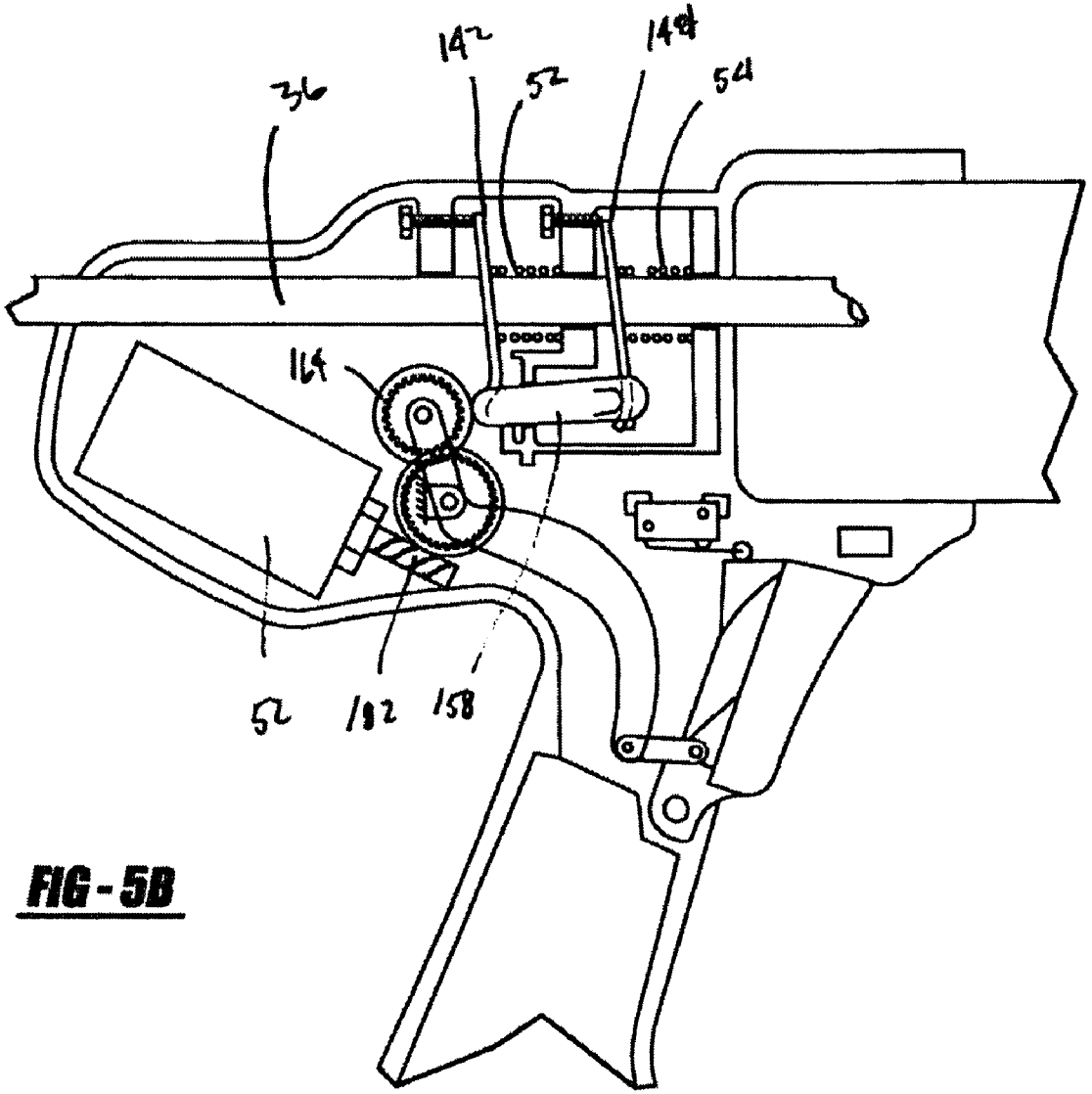
FIG. 5*b* is a cross-section view of the second embodiment of the present invention.

Turning to FIGS. 5*a*, 5*b*, a further embodiment of the invention is shown, in which elements marked with the same numerals have the same structure as similarly numbered elements in the first embodiment. Pinch plates 142 and 144 have a similar structure to pinch plates 42,44 and include apertures 150. Springs 52 and 54 apply a biasing force to pinch plates 142 and 144. Pinch plate 142 includes cam roller 156. Link plate 158 includes cam roller 160 disposed at one end and is linked to pinch plate 144 at the other end. Link plate 158 transfers camming action to pinch plate 144.

Cam rollers 156 and 160 roll upon cam surfaces 162 and 172 of radial lifting cams 168 and 170. As described above, the cam surfaces are disposed so as to be 180° out of phase with each such that one roller is being cammed forwardly while the other cam rides along a region of decreasing slope. As a result, pinch plates 142 and 144 act in an alternative manner to drive plunger rod 36 forwardly.

Cams 162 and 164 are mounted on common shaft 180 which is driven by motor 62. Motor 62 includes linkage 182, such as worm gear or a spur gear arrangement, to drive gear 184 fixed to shaft 186 which, in turn, drives shaft 180 though further intermediate gears. Squeezing of the trigger causes shaft 180 to move in a direction perpendicular to its axis to provide translational movement of cams 162, 164 in a direction perpendicular to their rotational axes.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fluid discharger comprising:

a housing;

a plunger including a rod, said plunger disposed adjacent to a mass of fluid receivable in said housing, said plunger movable in a first direction to act upon and discharge the fluid from the housing;

a first plate and a second plate each having an opening, said plunger rod disposed through said openings, said first and second plates having a first position relative to said plunger rod, said first plate having an associated first cam follower and said second plate having an associated second cam follower;

a first translationally movable and rotatable cam and a second translationally movable and rotatable cam, translational movement of said first and second cams causing axial movement of said first and second plates, respectively, to move said first and second plates into a second position relative to said plunger rod, wherein;

when said first and second plates are in the second position, rotation of said first cam and said second cam causes said first and second plates to push said plunger in the first direction to discharge fluid, and the pushing provided to said plunger by said first plate alternates with the pushing provided to said plunger by said second plate.

2. The fluid discharger recited in claim 1 further comprising a translationally movable and rotatable shaft, said first and second cams fixed upon said shaft, wherein, translational and rotational movement of said shaft provides the translational and rotational movement to said first cam and said second cam, said cams having camming surfaces and said cams disposed on said shaft such that said camming surfaces are out of phase with each other.

3. The fluid discharger recited in claim 2, wherein, when said first plate and said second plate are in the second position, during rotation of said shaft both said first cam and said second cam remain in contact with their respective cam follower throughout the rotation.

4. The fluid discharger recited in claim 2 further comprising a first spring biasing said first plate into contact with said first cam and a second spring biasing said second plate into contact with said second cam, and the translational movement of said shaft and said first and second cams is axial movement, said cams disposed on said shaft such that said camming surfaces are 180° out of phase with each other.

5. The fluid discharger recited in claim 4 further comprising:

a motor driving said shaft in rotation;

an on/off switch controlling operation of said motor; and a a trigger mechanically connected to said shaft, wherein, when said trigger is squeezed, said shaft is moved axially.

6. The fluid discharger recited in claim 5, said trigger mechanically connected to said switch such that when said trigger is squeezed said motor is switched on.

7. The fluid discharger recited in claim 6, said mass of dischargeable fluid contained in a cartridge removably received in said housing, said cartridge having a piston, said cartridge disposed in said housing with said piston disposed adjacent said plunger, movement of said plunger in the first direction causing said piston to be moved within said cartridge to discharge the fluid from said cartridge.

8. The fluid discharger recited in claim 1, said first cam follower disposed upon said first plate, said discharger further comprising a linking plate secured to said second plate, said second cam follower disposed upon said linking plate.

9. The fluid discharger recited in claim 8, said first and second cams comprising radial lift cams and disposed on a common axis such that their camming surfaces are 180° out of phase with each other.

10. A fluid discharger comprising:

a housing;

a plunger including a rod, said plunger disposed adjacent to a mass of fluid when the fluid is received in said housing, said plunger movable in a first direction to act upon and discharge the fluid;

a first pinch plate having a first opening, said plunger rod disposed through said first opening, said first plate having a first associated cam follower;

a rotatable and translationally movable shaft, a first cam fixed on said shaft, translational movement of said shaft moving said first pinch plate from a first position in which said plunger rod is substantially freely movable though said first opening and into a second position in which rotation of said first cam cams said first cam follower to move said first pinch plate so as to alternately pinch and release said plunger rod to thereby move said plunger rod in the first direction to discharge fluid;

a motor driving said shaft in rotation;

a trigger linked to said shaft, actuation of said trigger translationally moving said shaft and said first cam disposed thereon;

a first switch controlling operation of said motor, actuation of said trigger switching said switch to an on position to cause said motor to operate;

a locking plate having a through hole, said plunger rod disposed through said through hole and said locking plate biased to pinch said plunger rod; and an actuator which is movable between a first position in which it allows said locking plate to be biased to pinch said plunger rod and a second position in which it retains said locking plate against the bias in a position where the plunger rod may move substantially freely through said through hole.

11. The fluid discharger recited in claim 10, said actuator comprising a second switch disposed in a circuit including said first switch and said motor, wherein, when said actuator is in the second position, the circuit may be closed by actuation of said trigger to switch the first switch to an on position, causing said motor to operate, and when said actuator is in the first position, the circuit cannot be closed by actuation of said trigger to switch the first switch to an on position and the motor cannot be caused to operate and said discharger can only be used in a manual discharging mode through the translational movement of said shaft.

12. The fluid discharger recited in claim 10 further comprising:

a second pinch plate having a second opening, said plunger rod disposed through said second opening, said second pinch plate having a second cam follower associated therewith;

a second cam fixed on said shaft, translational movement of said shaft moving said second plate from a first position in which said plunger rod is substantially freely movable though said second opening and into a second position in which rotation of said second cam cams said second cam follower to move said second pinch plate to alternately pinch and release said plunger rod to thereby move said plunger rod in the first direction to discharge fluid; wherein, the camming applied by said first cam on the first cam follower is out of phase with the camming applied by said second cam on said second cam follower.

13. The fluid discharger recited in claim 12, wherein, the camming applied by said first cam is substantially 180° out of phase with the camming applied by said second cam.

14. The discharger recited in claim 12, said first cam follower disposed upon said first plate, said discharger further comprising a linking plate secured to said second plate, said second cam follower disposed upon said linking plate.

15. The fluid discharger recited in claim 12, said first cam follower disposed upon said first plate and said second cam follower disposed upon said second plate, wherein, the translational movement of said shaft and said first and second cam is axial movement.

16. The discharger recited in claim 10, said mass of dischargeable fluid contained in a cartridge removably received in said housing, said cartridge having a piston, said cartridge disposed in said housing with said piston disposed adjacent said plunger, movement of said plunger in the first direction causing said piston to be moved within said cartridge to discharge the fluid from said cartridge.

17. The discharger recited in claim 10, wherein the translational movement of said shaft and said first cam is axial movement.

18. A fluid discharger comprising:

a housing, a mass of dischargeable fluid receivable in said housing;

a plunger including a rod having an axis, said plunger disposed adjacent to the mass of fluid when the fluid is received in said housing, said plunger movable in a first direction to act upon and discharge the fluid;

a first plate and a second plate each having an opening, said plunger rod disposed through said openings, said first plate having a first cam follower associated therewith and said second plate having a second cam follower associated therewith;

first and second rotatable and translationally movable cams, wherein, said first and second plates are biased towards said first and second cams, respectively, and in an initial position of said first and second cams, said first and second pinch plates are biased at angles relative to said plunger rod which allows said rod to move freely through said plate openings, and when said cam are moved to a second axial position, rotation of said first and second cams causes each plate to alternately grip said plunger rod and move said plunger rod in the first direction to discharge fluid.

19. The fluid discharger recited in claim 18 further comprising:

a translationally movable and rotatable shaft, said first and second cam mounted on said shaft so as to rotate and translate therewith;

first and second springs, each said spring biasing a respective first and second plate into contact with a respective cam;

a motor, operation of said motor causing said shaft to rotate;

and a trigger, operation of said trigger causing said shaft to move axially.

20. The fluid discharger recited in claim 19 further comprising an on/off switch, said trigger operating said on/off switch to control operation of said motor.

21. The fluid discharger recited in claim 20 further comprising a master switch, wherein when said master switch is on, said trigger controls operation of said on/off switch to control operation of said motor, and when said master switch is off, said motor cannot be switched on by operation of said trigger.

22. The fluid discharger recited in claim 19 further comprising a master switch, wherein when said master switch is on said motor is turned on and when said master switch is off, said motor is off.

* * * * *